US006928691B2

(12) United States Patent
Freeman

(10) Patent No.: US 6,928,691 B2
(45) Date of Patent: Aug. 16, 2005

(54) TRASH CAN/VACUUM COMBINATION

(76) Inventor: Andrew S. Freeman, 2607 Finch St., Wheaton, MD (US) 20902

( * ) Notice: Subject to any disclaimer, the term of this patent is extended or adjusted under 35 U.S.C. 154(b) by 348 days.

(21) Appl. No.: 10/294,556

(22) Filed: Nov. 15, 2002

(65) Prior Publication Data

US 2004/0093686 A1 May 20, 2004

(51) Int. Cl.[7] ..... A47L 5/00; A47L 7/00; A47L 9/00

(52) U.S. Cl. ..... 15/339; 15/310

(58) Field of Search ..... 15/301, 310, 339

(56) References Cited

U.S. PATENT DOCUMENTS 971,895 A * 10/1910 Joedicke ..... 55/493
2,013,498 A * 9/1935 McConaughy ..... 55/376
3,994,528 A * 11/1976 Humphrey ..... 297/182
4,360,947 A 11/1982 DeCosa et al.
5,205,013 A 4/1993 Lopes
5,560,077 A * 10/1996 Crotchett ..... 15/339
5,664,285 A * 9/1997 Melito et al. ..... 15/352
5,946,768 A 9/1999 Kelly
5,953,788 A * 9/1999 Douglas ..... 15/339
6,199,714 B1 * 3/2001 Thompson ..... 220/495.07
6,286,177 B1 9/2001 Robinson
6,675,436 B1 * 1/2004 Fratoni, Jr. ..... 15/310
6,732,403 B2 * 5/2004 Moore et al. ..... 15/339

* cited by examiner

*Primary Examiner*—Terrence R. Till
(74) *Attorney, Agent, or Firm*—Richard C. Litman

(57) ABSTRACT

A combination trash can and vacuum cleaner in which the base of a trash can contains a battery operated vacuum cleaner that is activated by any one of a number of foot pedals. The vacuum is contained in a housing with an internal fan, a debris collection chamber, and an electrically controlled trap door for emptying debris. The device allows for in-room storage of a vacuum cleaner in an aesthetically pleasing manner and for the collection of debris without the need for a dustpan and/or a conventional vacuum cleaner.

11 Claims, 7 Drawing Sheets

TRASH CAN/VACUUM COMBINATION

BACKGROUND OF THE INVENTION

1. Field of the Invention

The present invention relates to trash cans and vacuum cleaners and, more particularly, to a combination trash can and vacuum cleaner.

2. Description of Related Art

The related art does not teach a combination trash can and vacuum cleaner, the subject matter of the instant invention. However, it does teach vacuum cleaners combined with other items such as, for example, a decorative plant base, a kitchen cabinet, an ash bucket and a mobile workstation.

U.S. Pat. No. 5,205,013 to Lopes, teaches a combined decorative plant base and vacuum cleaner for use in hair cutting salons. The device consists of a vacuum cleaner hidden inside the base of a box-like container that also serves as a decorative plant base. The device allows for in-room storage of a vacuum cleaner in an aesthetically pleasing manner. A user of the device removes hair from a salon floor by sweeping the hair to an opening at the base of the device from where the hair is vacuumed into a storage container.

Similarly, U.S. Pat. No. 6,286,177 to Robinson, teaches an under-cabinet vacuum with an intake vent positioned at floor level. With the device, debris can be swept under the overhang of an under-counter kitchen cabinet and vacuumed into a collection bin. Thus, both of the devices taught by Lopez and Robinson incorporate vacuums hidden within structures displayed in plain sight, thereby providing access to a vacuum without the typical lifting and carrying associated with a conventional vacuum, while at the same time avoiding the unpleasing visual aspect of storing a conventional vacuum in plain sight. However, neither of the devices taught by Lopes or Robinson can also serve as a trash can.

U.S. Pat. No. 4,360,947 to DeCosa et al., teaches an ash bucket and vacuum combination in which the bucket is connected to a vacuum cleaner via a hose. The bucket is also attached, via a vacuum hose, to a hand-held dustpan. Ash from a fireplace can be shoveled directly into the bucket using the dustpan or can be swept into the dustpan and then vacuumed through the hose into the bucket. From the bucket, ash can then be vacuumed into a vacuum cleaner. Although well suited for cleaning a fireplace, the device is not suited for use as a combination trash can and vacuum cleaner, particularly in a home or office setting where its appearance would be inconsistent with typical home or office furnishings.

U.S. Pat. No. 5,946,768 to Kelly teaches a mobile workstation with an integrated vacuum cleaner. The workstation is mounted on wheels and provides a level work surface and cabinet space for storing tools and equipment. However, although useful for cleaning offices and rooms, the device is not useful as a trash can nor is it appropriate for storage in plain sight within a home or office.

Consequently, none of the above inventions and patents, taken either singularly or in combination, is seen to describe the instant invention as claimed. Thus a trash can/vacuum combination solving the aforementioned problems is desired.

SUMMARY OF THE INVENTION

The present invention is a combination trash can and vacuum in which the base of the trash can contains a battery operated vacuum cleaner. The vacuum cleaner is activated by a foot pedal and is contained in a housing with an internal fan, a debris collection chamber, and an electronically controlled trap door for emptying debris. Four foot pedals encircle the base of the housing. When depressed, any one of the foot pedal forms the lower edge of an opening into the vacuum. Debris is swept over the depressed pedal and into the opening, where it is then drawn into a collection chamber.

Accordingly, it is a principal object of the invention to provide a combination trash can and vacuum cleaner allowing for the collection of waste, such as paper and other refuse, and also allowing for the collection of debris without the use of a dustpan or a conventional vacuum cleaner.

It is another object of the invention to provide an aesthetically pleasing device in which a vacuum cleaner can be stored, thereby providing easy access to a vacuum cleaner without the unsightliness of a conventional vacuum cleaner.

It is a further object of the invention to eliminate the necessity of bending over commonly associated with the use of a dustpan and broom.

Still another object of the invention is to eliminate the necessity of retrieving, i.e., lifting and carrying, a conventional vacuum cleaner to an area in which debris is located.

Still another object of the invention is to facilitate the transfer of debris in a simple and efficient manner that requires minimal physical effort.

Furthermore, it is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
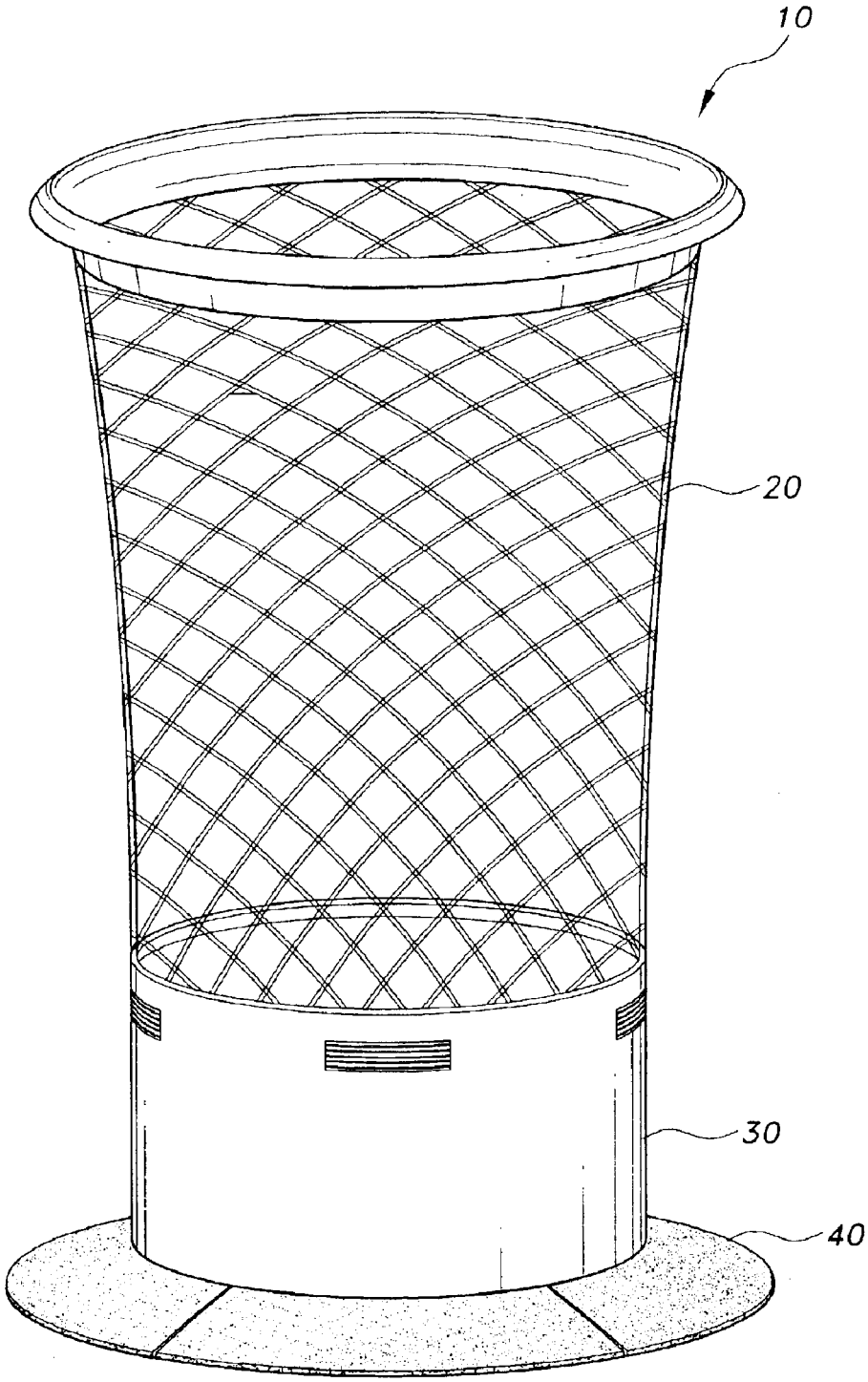
FIG. 1 is a front perspective view of a trash can/vacuum combination according to the present invention.

FIG. 1 shows a trash can/vacuum combination 10 according to the present invention. It will be appreciated from the view that the device comprises two main components: 1) a trash can 20 mounted on top of a 2) vacuum cleaner 30. It will also be appreciated that the vacuum cleaner 30 is cylindrical in shape with vents on its sides and with four curve pedals 40 encircling its base.

Figure 2:
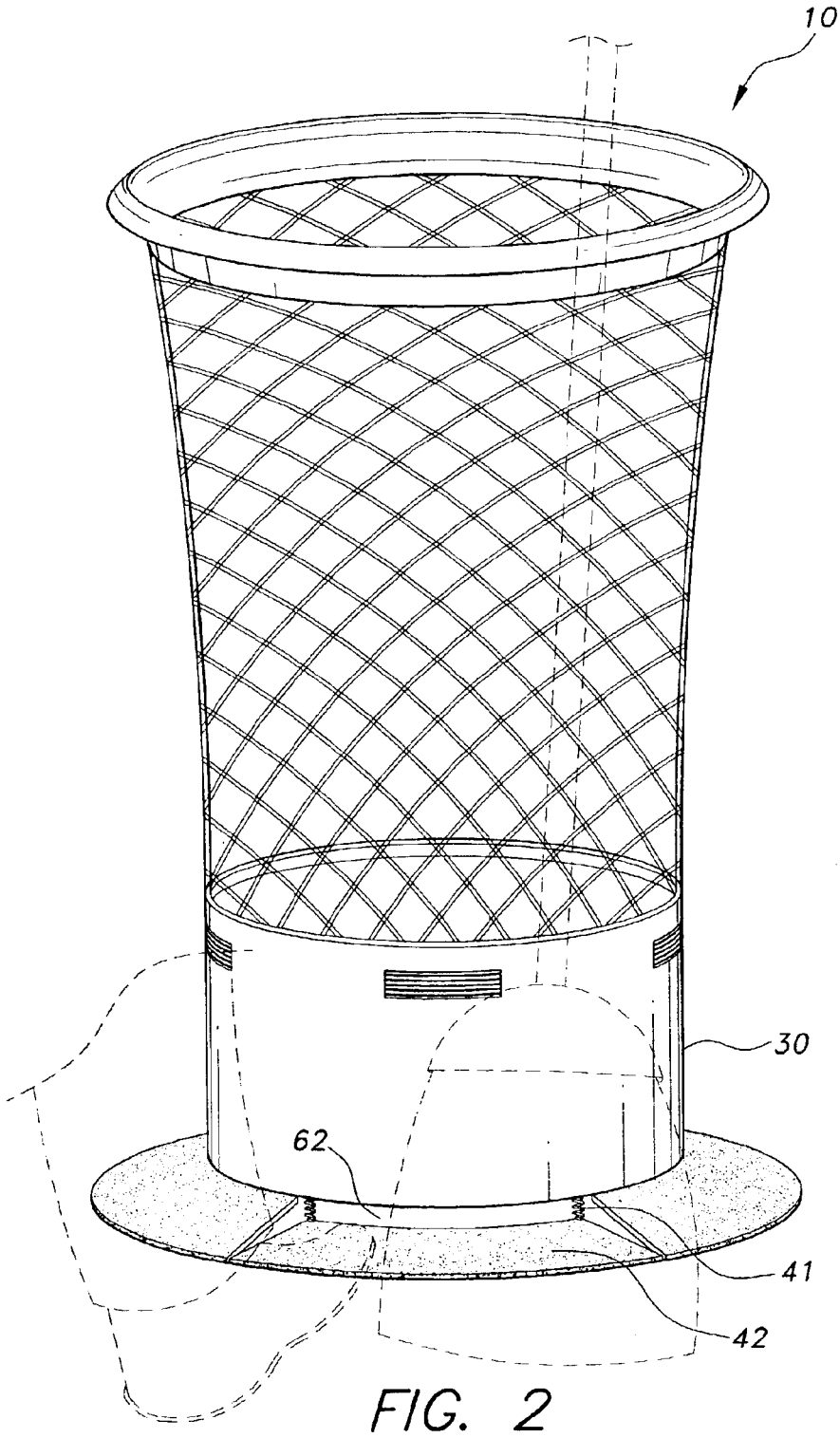
FIG. 2 is an environmental, perspective view of a trash can/vacuum combination, showing a foot pedal depressed, in ghost lines.

FIG. 2 shows one foot pedal 42 depressed. An opening 62 is formed by the bottom edge of the vacuum cleaner 30 and the top of the depressed pedal. Two springs 41 connect pedal 42 to the base of the vacuum cleaner 30. When pedal 42 is depressed, the vacuum cleaner is activated thereby causing reduced air pressure at the opening 62. Debris is swept over the pedal 42 and into the opening 62 in a manner similar to that in which debris would be swept into a dustpan. Once debris is swept into the opening 62, the debris is drawn into the vacuum cleaner 30 by the reduced air pressure.

Figure 3:
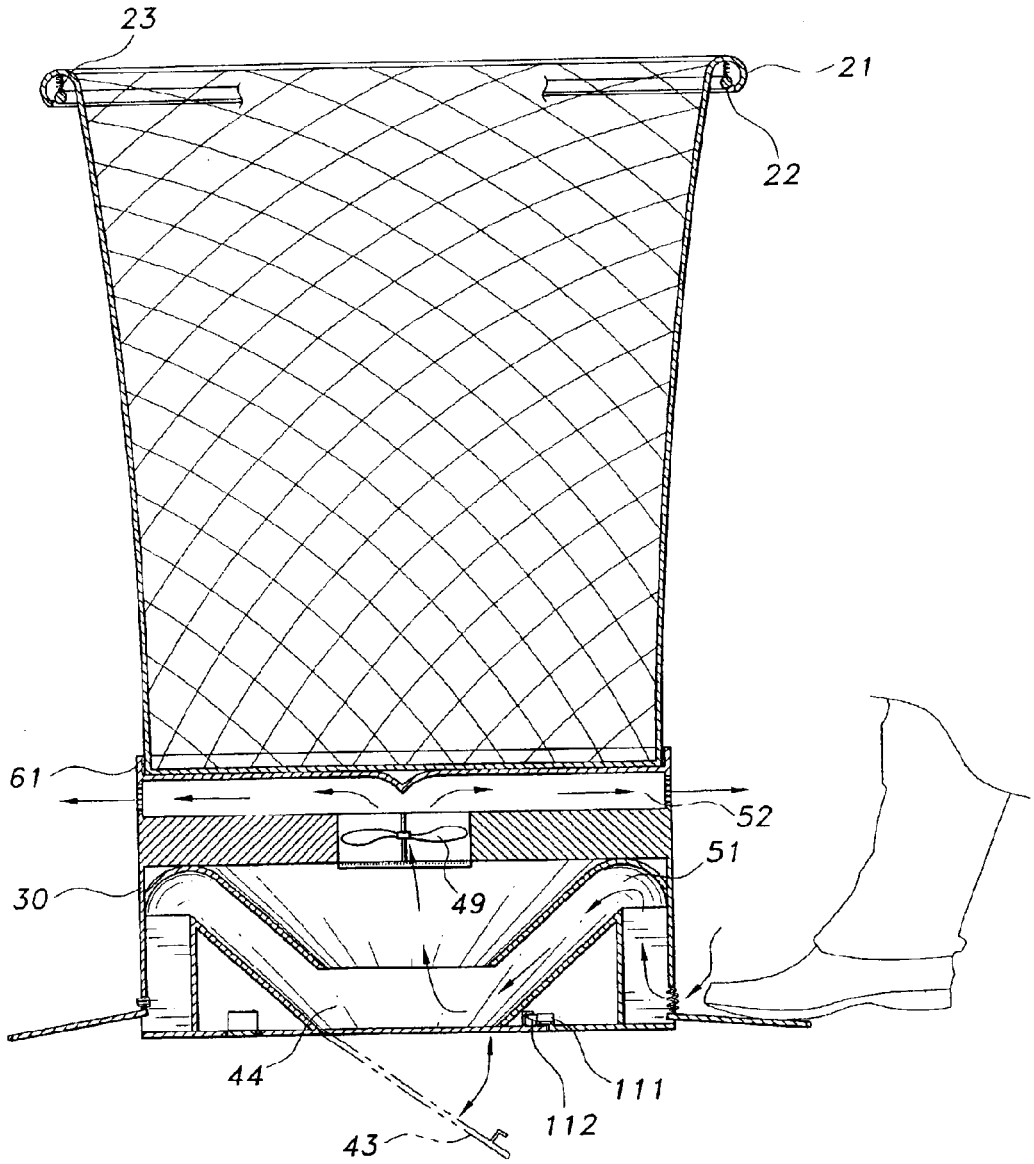
FIG. 3 is an elevational cross-section view of a trash can/vacuum combination.

FIG. 3 shows trash can component 20 welded to a rim 61 that extends vertically upward from the vacuum cleaner component 30. The rim 21 of the trash can component 20 is rounded in a manner that provides an overhang, concaved upward, under which a ring 22 is attached. The ring 22 encircles the trash can and is attached to the underside of the rim 21 via a plurality of springs 23. When the ring 22 is squeezed upward into the rim 21, the latch 112 of an electronic release mechanism 111 releases a trap door 43 on the bottom of the vacuum cleaner component.

Figure 4:
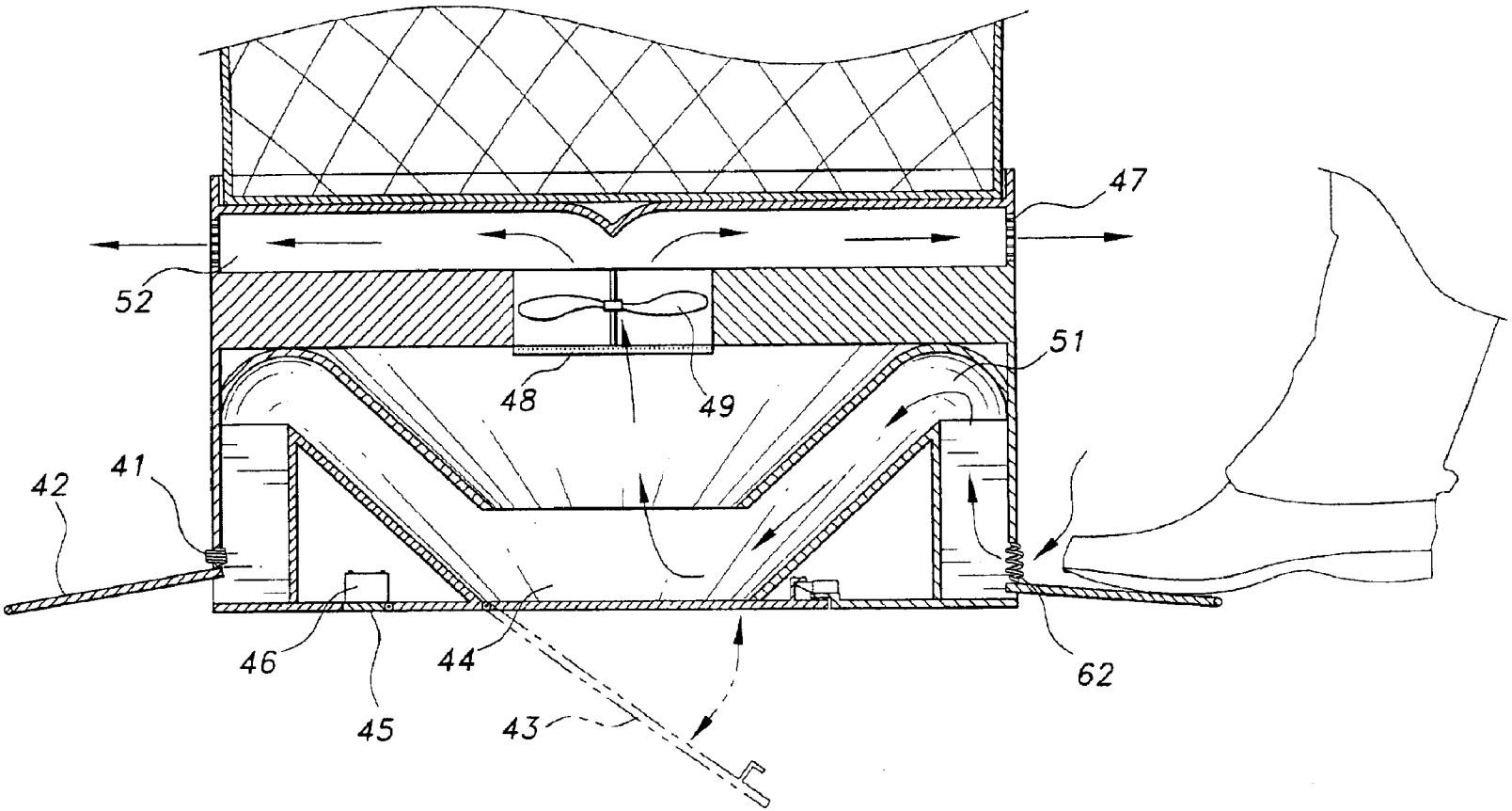
FIG. 4 is a partial cross-sectional view of the vacuum housing of a trash can/vacuum combination.

The internal works of the vacuum cleaner component 30, described in more detail in the discussion of FIG. 4, include an intake chamber 51, a collection chamber 44, a fan 49 and a discharge chamber 52.

FIG. 4 illustrates a pedal 42 attached to the vacuum cleaner via springs 41. When any one pedal 42 is depressed, the fan 49 is activated. The fan 49 draws air and debris into the vacuum cleaner through the opening 62 formed by the bottom edge of the vacuum cleaner and the top of the pedal, through an intake chamber 51 through a collection chamber 44, and through a screen 48 that filters the debris from the air. The air is then forced, by the fan 49, into a discharge chamber, and then out of the vacuum cleaner through vents 47 on its side. The filtered debris drops to the floor of the collection chamber 44.

A hinged trap door 43 is attached to the bottom of the vacuum cleaner component and comprises the floor of the collection chamber 44. When the trap door 43 is opened, debris in the collection chamber 44 drops out of the vacuum cleaner component thereby allowing the collection chamber 44 to be emptied.

Access to a battery compartment 46 is provided by a hinged access door 45. Batteries are used to power the fan 49 and the trap door release mechanism 111.

Figure 5:
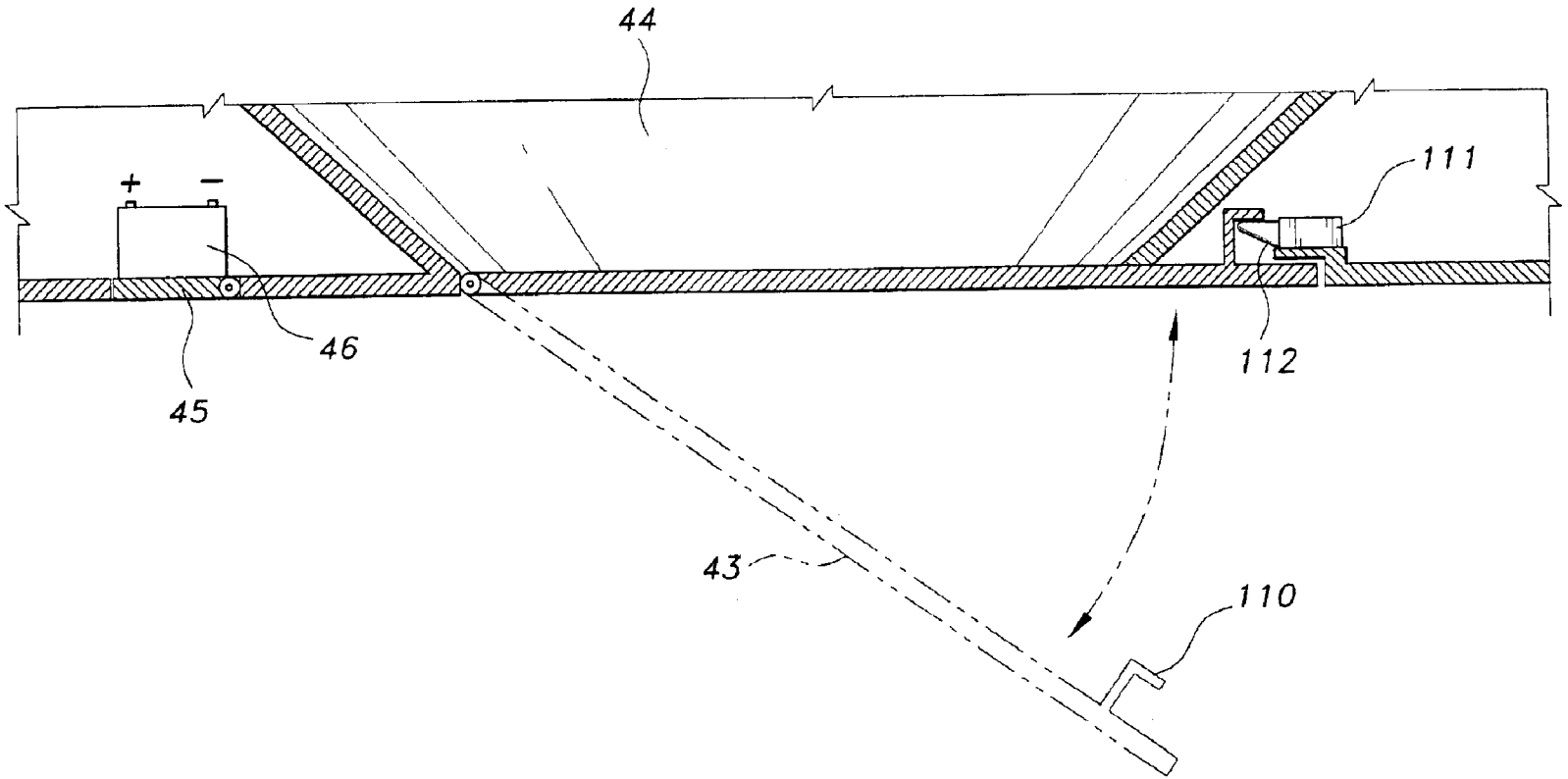
FIG. 5 is a fragmentary cross-sectional view of the trap door of a trash can/vacuum.

FIG. 5 shows trap door 43 attached to the bottom of the vacuum cleaner component. A latch 112 holds the trap door 43 in the closed position. The release mechanism 111 moves the latch 112 thereby allowing the trap door 43 to swing open and allowing the collection chamber 44 to be emptied. Also shown is the battery compartment and its hinged access door 45.

Figure 6:
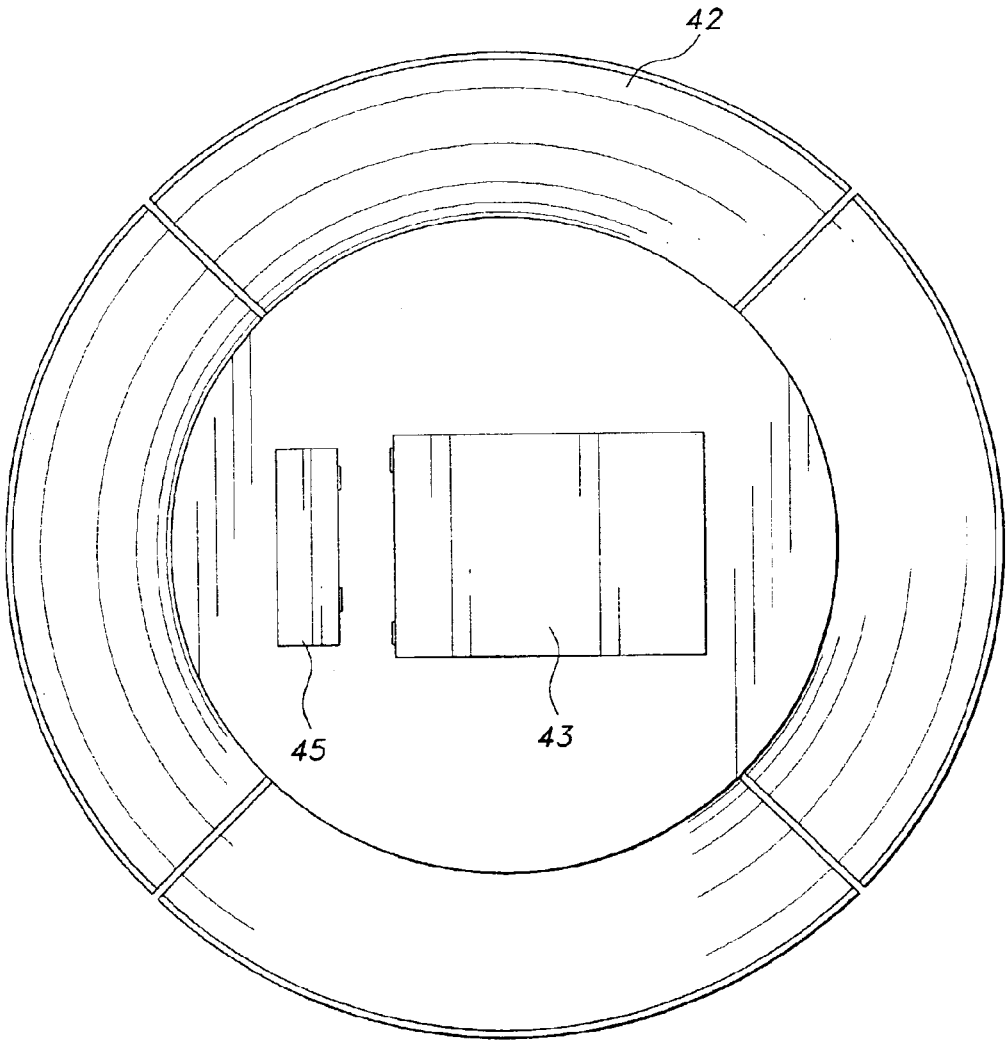
FIG. 6 is a bottom view of a trash can/vacuum combination.

FIG. 6 shows the hinged access door 45 to the battery compartment, the hinged trap door 43 to the collection chamber and the underside of foot pedal 42.

Figure 7:
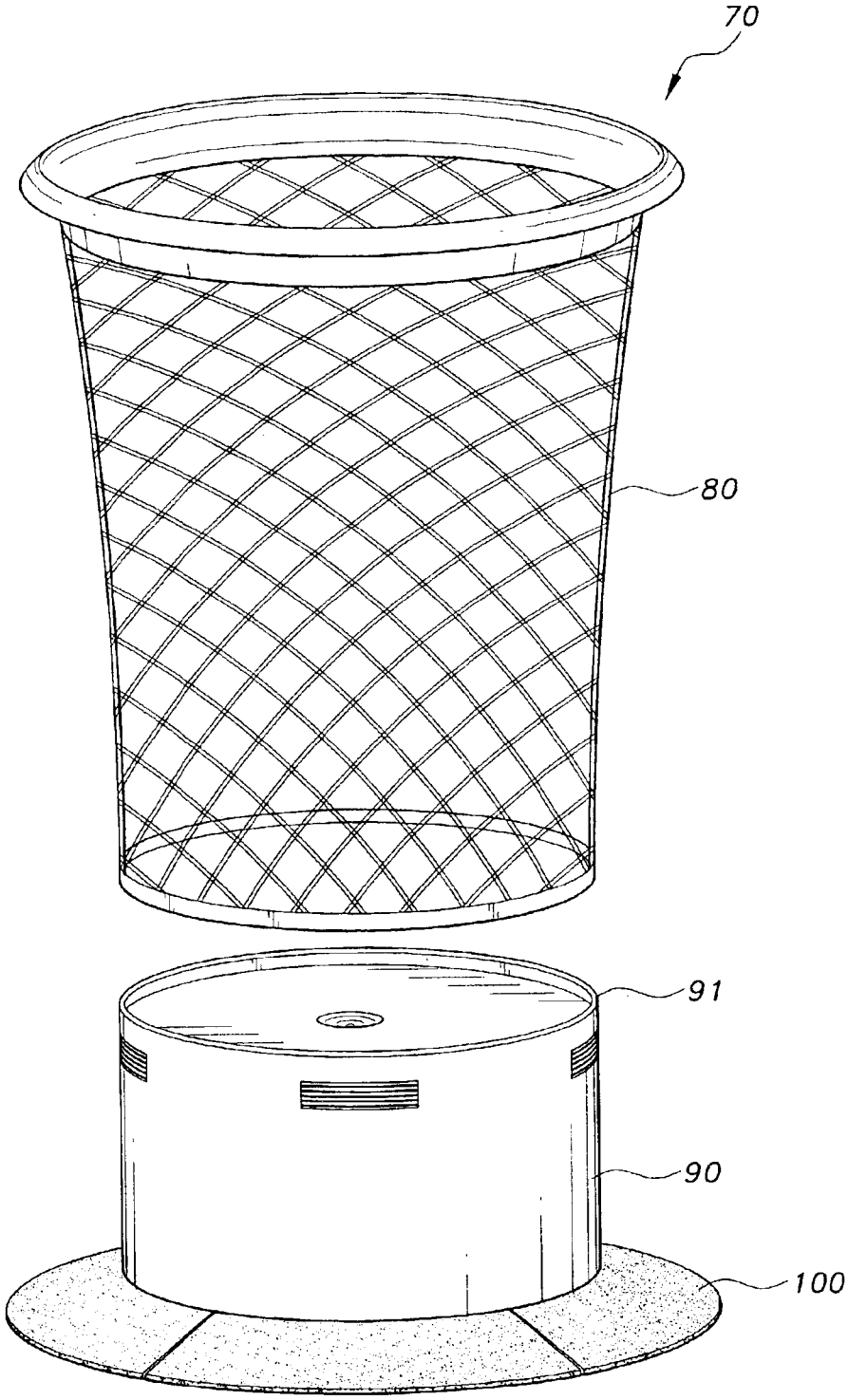
FIG. 7 is a partly exploded perspective view of an alternative embodiment of a trash can/vacuum combination.

FIG. 7 illustrates an alternative embodiment of a trash can/vacuum combination 10 in which the trash can component 80 is capable of being separated from the vacuum cleaner component 90. In this embodiment, the vacuum cleaner component 90 and all its workings are the same as those of the preferred embodiment with the exception of the trap door release mechanism which is activated by depressing a button on the bottom of the vacuum cleaner component. The rim of the trash can component does not include a ring attached to its underside. The rim 91 on the top of vacuum cleaner component 90 is shaped and dimensioned to accommodate a standard size trash can.

It is to be understood that the present invention is not limited to the embodiments described above, but encompasses any and all embodiments within the scope of the following claims.

I claim:

1. A trash can/vacuum combination comprising:

a trash can component, said trash can component being mounted on top of said vacuum cleaner component;

said trash can component is designed and configured to collect trash; and a vacuum cleaner component, said vacuum cleaner component including an outer container, a fan, a screen, and internal walls;

said fan, said screen, and said internal walls being contained within said outer container;

said internal walls shaped and dimensioned to form an intake chamber, a collection chamber and a discharge chamber;

wherein said intake chamber opens into said collection chamber, said collection chamber opens into said discharge chamber, said fan and said screen is positioned between said collection chamber and said discharge chamber, and said outer container is cylindrical in shape having a substantially flat top and a substantially flat bottom, and at least one vent that opens into said discharge chamber, and with at least one opening that opens into said intake chamber;

whereby said fan causes an air flow through said vacuum cleaner component, the air flow follows a flow path in through said intake chamber, through said collection chamber, through said screen, through said fan, through said discharge chamber, and out of said vent; and debris is collected in said vacuum cleaner component.

2. The trash can/vacuum combination according to claim 1, further comprising:

a hinged trap door affixed to the bottom of said outer container; and a trap door latch mechanism affixed to said outer container;

said trap door latch mechanism normally holding said trap door in a closed position;

whereby, when the latch of said trap door latch mechanism is withdrawn, said trap door is released thereby allowing debris collected within said vacuum cleaner component to be emptied.

3. The trash can/vacuum combination according to claim 2, further comprising:

at least one opening positioned on side of and at the base of said outer container, and opening into said intake chamber;

at least one curved foot pedal extended outward from said outer container, said foot pedal being substantially flat with a top, a bottom, a proximal edge, a distal edge, and two side edges, with said distal edge resting on a floor; and there further being an opening for each corresponding foot pedal, and with each opening being covered by its corresponding foot pedal, an opening being exposed and a proximal edge of said corresponding foot pedal being aligned with the base of said opening, when a corresponding foot pedal is depressed;

whereby, debris is swept into an opening by being swept onto the distal edge of its depressed corresponding foot pedal, across said depressed corresponding foot pedal and off said proximal edge of said depressed corresponding foot pedal.

4. The trash can/vacuum combination according to claim 3, further comprising:

a battery compartment contained within said outer container;

a hinged door affixed to the bottom of said outer container;

said battery compartment accessible via said hinged door;

said battery compartment shaped and dimensioned to accommodate at least one battery; and said battery compartment electrically connected to said fan;

whereby depressing a foot pedal activates said fan, thereby drawing air and debris into said intake chamber from the opening exposed by depressing said foot pedal.

5. The trash can/vacuum combination according to claim 4, wherein said trash can component is essentially cylindrical in shape, the sides of said trash can component are fabricated of wire mesh; and the top of said trash can component is open.

6. The trash can/vacuum combination according to claim 5, wherein said trash can component is secured to said vacuum cleaner component such that lifting said trash can by its rim also lifts said vacuum cleaner component.

7. The trash can/vacuum combination according to claim 6, further comprising:

a rim of said trash can component, extending outward from the sides of said trash can component; said rim being rounded such it provides an overhang that is concaved upward;

a plurality of suspension springs;

a ring attached to the underside of said rim via said plurality of suspension springs, said ring encircling said trash can component; and means for withdrawing said latch into said trap door latch mechanism incorporated in said trap door latch mechanism, said means being activated by squeezing said ring upward toward said rim;

whereby, when said ring is squeezed upward toward said rim, said means for withdrawing said latch is activated, thereby withdrawing said latch and releasing said trap door.

8. A vacuum cleaning device comprising: an outer container;

a fan;

a screen; and internal walls;

said fan, said screen, and said internal walls being contained within said outer container;

said internal walls shaped and dimensioned to form an intake chamber, a collection chamber and a discharge chamber;

said intake chamber opening into said collection chamber;

said collection chamber opening into said discharge chamber;

said fan and said screen positioned between said collection chamber and said discharge chamber; and said outer container being cylindrical in shape with a substantially flat top and a substantially flat bottom, with at least one vent that opens into said discharge chamber, and with at least one opening that opens into said intake chamber;

whereby air flows through said vacuum cleaner component by flowing into said intake chamber, through said collection chamber, through said screen, through said fan, through said discharge chamber, and out of said vent; and whereby top of said outer container means is capable of supporting a trash can without said trash can being secured to said outer container.

9. The vacuum cleaning device according to claim 8, further comprising:

a hinged trap door affixed to bottom of said outer container means; and a trap door latch mechanism affixed to said outer container;

said trap door latch mechanism normally holding said trap door in a closed position;

whereby, when the latch of said trap door latch mechanism is withdrawn, said trap door is released, thereby allowing debris collected within said vacuum cleaner component to be emptied.

10. The vacuum cleaning device according to claim 9, further comprising:

at least one opening positioned on side of and at the base of said outer container and opening into said intake chamber;

at least one curved foot pedal extended outward from said outer container, said foot pedal being substantially flat with a top, a bottom, a proximal edge, a distal edge, and two side edges, with said distal edge resting on a floor; and there further being an opening for each corresponding foot pedal, and with each opening being covered by its corresponding foot pedal, an opening being exposed and a proximal edge of said corresponding foot pedal being aligned with the base of said opening, when a corresponding foot pedal is depressed;

whereby, debris is swept into an opening by being swept onto the distal edge of its depressed corresponding foot pedal, across said depressed corresponding foot pedal, and off said proximal edge of said depressed corresponding foot pedal.

11. The vacuum cleaning device according to claim 10, further comprising:

a battery compartment contained within said outer container;

a hinged door affixed to the bottom of said outer container;

said battery compartment accessible via said hinged door;

said battery compartment shaped and dimensioned to accommodate at least one battery; and said battery compartment electrically connected to said fan;

whereby depressing a foot pedal activates said fan, thereby drawing air and debris into said intake chamber from the opening exposed by depressing said foot pedal.

* * * * *